US011537087B2

(12) United States Patent
Klopfenstein et al.

(10) Patent No.: US 11,537,087 B2
(45) Date of Patent: Dec. 27, 2022

(54) METHOD FOR ADJUSTING THE MEAN FREQUENCY OF A TIME BASE INCORPORATED IN AN ELECTRONIC WATCH

(71) Applicant: ETA SA Manufacture Horlogere Suisse, Grenchen (CH)

(72) Inventors: Francois Klopfenstein, Delemont (CH); Xavier Stehlin, Cudrefin (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 735 days.

(21) Appl. No.: 16/575,609

(22) Filed: Sep. 19, 2019

(65) Prior Publication Data

US 2020/0096951 A1 Mar. 26, 2020

(30) Foreign Application Priority Data

Sep. 20, 2018 (EP) ..... 18195819

(51) Int. Cl.
*G04R 20/26* (2013.01)
*G04C 3/10* (2006.01)
(Continued)

(52) U.S. Cl.
CPC ..... *G04R 20/26* (2013.01); *G04C 3/107* (2013.01); *G04C 3/12* (2013.01); *G04D 7/1207* (2013.01); *G04G 3/04* (2013.01)

(58) Field of Classification Search
CPC ..... G04C 3/12; G04C 3/107; G04R 20/26; G04D 7/1207; G04G 3/04
See application file for complete search history.

(56) References Cited

U.S. PATENT DOCUMENTS 4,086,755 A 5/1978 Ueda
5,918,041 A * 6/1999 Berstis ..... G06F 1/14 713/503
(Continued)

FOREIGN PATENT DOCUMENTS

CH 707 285 A2 5/2014
CN 1297544 A 5/2001
(Continued)

OTHER PUBLICATIONS

Office Action dated Oct. 29, 2020 in corresponding Korean Patent Application No. 10-2019-0114691 (with English Translation), 8 pages.
(Continued)

*Primary Examiner* — Sean Kayes
(74) *Attorney, Agent, or Firm* — Oblon, McClelland, Maier & Neustadt, L.L.P.

(57) ABSTRACT

A method and device for determining a constant parameter of an inhibition value for adjusting the device operating frequency of a watch equipped with a quartz oscillator. The following steps are performed by a self-calibration circuit of the electronic watch device: from a first external pulse and a second external pulse received from a system external to the watch and separated by a measurement time, corresponding to a reference number of reference periods for a periodic calibration signal derived from the time-measurement signal and having a calibration frequency derived from the natural frequency of the quartz oscillator, determining a calibration parameter representative of a ratio between a calibration period and a reference period for the periodic calibration signal, and determining a constant inhibition parameter as a function of the calibration parameter.

25 Claims, 3 Drawing Sheets

(51) Int. Cl.

| | |
|---|---|
| ***G04C 3/12*** | (2006.01) |
| ***G04D 7/12*** | (2006.01) |
| ***G04G 3/04*** | (2006.01) |

(56) References Cited

U.S. PATENT DOCUMENTS

| | | | | |
|---|---|---|---|---|
| 10,295,962 | B2 * | 5/2019 | Klopfenstein | G04G 3/04 |
| 2016/0299475 | A1 | 10/2016 | Baba et al. | |
| 2017/0139377 | A1 | 5/2017 | Klopfenstein et al. | |

FOREIGN PATENT DOCUMENTS

| | | | |
|---|---|---|---|
| CN | 1448812 | A | 10/2003 |
| CN | 107015471 | A | 8/2017 |
| EP | 3 079 025 | A1 | 10/2016 |
| EP | 3 168 695 | A1 | 5/2017 |

OTHER PUBLICATIONS

Combined Chinese Office Action and Search Report dated Dec. 16, 2020 in corresponding Chinese Patent Application No. 201910891904.0 (with Partial English Translation and English Translation of Category of Cited Documents), 8 pages.

European Search Report dated Feb. 26, 2019 in European Application 18195819.0 filed on Sep. 20, 2018 (with English Translation of Categories of Cited Documents).

* cited by examiner

METHOD FOR ADJUSTING THE MEAN FREQUENCY OF A TIME BASE INCORPORATED IN AN ELECTRONIC WATCH

FIELD OF THE INVENTION

The invention concerns the field of electronic watches and more specifically a method for adjusting the mean frequency of a time base incorporated in an electronic watch.

BACKGROUND OF THE INVENTION

Electronic timepiece movements generally comprise an internal time base providing a time signal formed of periodic operating pulses and a display device receiving this time signal. The internal time base includes, in a known manner, an oscillator and a clock circuit. The oscillator, for example a quartz oscillator, is arranged to provide a periodic time-measurement signal Sosc having said natural frequency Fosc. The clock circuit is arranged to produce a clock signal Sh having the mean operating frequency Fhor of the watch from the time-measurement signal produced by the oscillator. The clock circuit is, for example, a frequency divider circuit, usually formed by a chain of dividers, generally of dividers-by-two. In a numerical example, the set frequency Fhor* of a clock signal Sh produced by an internal time base in an electronic watch is Fhor*=8,192 Hz, namely a quarter of the set frequency $Fosc^*=2^{15}=32{,}768$ Hz of a quartz oscillator incorporated in the internal time base.

In industrial production, it is, however, difficult to mass produce oscillators for electronic watches that all have a well-defined natural frequency allowing a clock signal to be obtained at the time base output whose operating frequency reaches the required, increasingly higher levels of precision, of around 5 seconds per year, or less for very precise time bases.

Thus, it is known to make oscillators which, at the end of the manufacturing phase, produce a time signal with a true natural frequency Fosc in a slightly higher frequency range than the desired set frequency, e.g. Fosc=32,771 Hz or 32,772 Hz for a set frequency Fosc*=32,768 Hz, and then to best adjust the clock signal produced by the time base by associating a frequency adjustment circuit with this time base. In a known manner, an adjustment circuit provides an inhibition signal to the clock circuit which acts to remove, at a certain level of the divider, a number of periods from a signal Sint internal to the clock circuit during successive inhibition periods, for example for around a few seconds to a few minutes, to correct the mean operating frequency Fhor of the signal produced by the internal time base of the watch.

The number of periods to be removed from the internal periodic signal per inhibition period Cinh corresponds to an inhibition value Vinh is which is determined individually for each oscillator. In the case of an oscillator that is not temperature compensated, the inhibition value is constant, independent of temperature. In the case of a temperature compensated oscillator, the inhibition value takes account of the temperature inside the watch and is given by a mathematical relation such that:

$$Vinh(T)=a\cdot T^4+b\cdot T^3+c\cdot T^2+d\cdot T+e$$

where T is the temperature measured by a sensor arranged inside the watch close to the quartz oscillator and where a, b, c, d, e are coefficients of the aforementioned polynomial, which are stored in a memory. At predefined instants, for example at each inhibition period or cycle, the adjustment circuit updates the inhibition value as a function of temperature and then acts to remove a corresponding number of periods in generating a predefined internal signal of the clock circuit.

Conventionally, special measuring and programming equipment is used to determine a deviation in the operating frequency of the watch with respect to a set frequency provided by an external clock and to programme the inhibition value in the electronic watch device. Such measuring and programming equipment is, however, particularly expensive and currently requires access to a resistive connection of the electronic device or an electrical contact with the electronic device.

SUMMARY OF THE INVENTION

It is an object of the invention to provide a technically simple and thus inexpensive solution for adjusting the mean operating frequency of electronic watches, and more specifically to compute the inhibition value associated with each electronic watch. More concretely, the invention proposes a novel self-calibration method consisting, for the electronic watch device, in determining by its own means a constant parameter of the inhibition value.

In the context of the invention, a 'constant parameter' means a parameter of the inhibition value that is independent of temperature. In the case of a time base which is not temperature compensated and whose inhibition value is defined by a constant value determined for the electronic watch in question, the constant value is this inhibition value. In the case of a temperature compensated time base whose inhibition value is defined by a mathematical relation as a function of temperature, the constant parameter is the coefficient or constant term of this mathematical relation.

To this end, the invention proposes a method for determining a constant parameter of an inhibition value, or constant inhibition parameter, for adjusting a mean operating frequency Fhor of an electronic watch including an electronic device comprising:

an internal time base comprising a time-measurement oscillator and a clock circuit, the time-measurement oscillator having a natural frequency Fosc and being arranged to provide a periodic time-measurement signal Sosc with natural frequency Fosc, the clock circuit being arranged to receive time-measurement signal Sosc and to provide a clock signal Sh with mean operating frequency Fhor, a circuit for adjusting mean operating frequency Fhor, including a memory storing at least said constant inhibition parameter, the adjustment circuit being arranged to inhibit, by predefined inhibition period and as a function of at least the constant inhibition parameter, one or more periods in the generation of a periodic signal Sint internal to the clock circuit involved in the generation of clock signal Sh, such that the mean operating frequency is more precise, the periodic internal signal being derived from the time-measurement signal, the method for determining the constant inhibition parameter being characterized in that it includes the following steps, consisting in:

ET1: from a first external pulse and a second external pulse received from a system external to the watch and separated by a is measurement time Tm corresponding to a reference number Nref of reference periods Pref for a periodic calibration signal Scal derived from time-measurement signal Sosc and having a calibration frequency Fcal derived from natural frequency Fosc, determining a calibration parameter M representative of a ratio between a calibration period Pcal equal to the inverse of calibration frequency Fcal and reference period Pref, ET2: determining a constant inhibition parameter as a function of the calibration parameter.

Thus, with the method of the invention, the determination of the constant parameter of the inhibition value (also referred to as the 'constant inhibition parameter') occurs essentially inside the watch and with the material means of the watch, the only elements external to the watch required to implement the invention being two pulses from an external reference clock and means of transmitting the two pulses to the watch. Existing means, such as a smartphone or a satellite constellation, are entirely suitable for this purpose and easily accessible. Calibration of the watch adjustment circuit can thus easily be performed at the end of manufacture and even be easily repeated as the watch is used, if necessary. Further, given that implementation of the method simply requires providing two pulses external to the watch, it is possible to simultaneously calibrate the adjustment circuit of several watches, by simultaneously sending the two external pulses to a large number of watches, which is particularly advantageous at the end of manufacture.

The method according to the invention can be implemented for initial determination of the constant inhibition parameter, typically at the end of the watch production line, or subsequently, for example, during servicing or repair of the watch.

The first external pulse and the second external pulse received by the calibration circuit are provided by an external system, such as, for example, a reference clock external to the watch or a device external to the watch, which includes or is coupled to an external reference clock. The first is external pulse and the second external pulse thus give the watch a precise value of the measurement time.

The watch calibration parameter, determined in step ET1, is representative of a period Pcal of the calibration signal with respect to reference period Pref for this calibration signal and is thus representative, if the calibration signal was not inhibited when generated from the time measurement signal, of a period Posc of the time-measurement signal with respect to a corresponding set period Posc*. In particular, the calibration period is equal to the ratio Pcal/Pref between a calibration signal period and a corresponding reference period.

The calibration period determined in step ET1 makes it possible to compute a calibration value Vcal=(1−M)·Cin/Pint where M is the calibration value given by the equality M=Pcal/Pref, Pint is the period of the non-inhibited or inhibited internal periodic signal (in this latter case it is a mean period), or a set period for this internal periodic signal, and Cinh is the expected inhibition period.

Depending on whether or not the periodic calibration signal is derived from the inhibited internal periodic signal, calibration value Vcal is respectively either a correction value of the inhibition value for correcting the constant inhibition parameter, or an instantaneous value for the inhibition value for determining the constant inhibition parameter.

In general, the constant inhibition parameter is:

in the absence of temperature compensation, the inhibition value; or a constant coefficient of a mathematical relation computing the inhibition value as a function of temperature.

In the absence of temperature compensation for the oscillator, the inhibition value is constant, and we can distinguish two cases. In a first case where the periodic calibration signal has not been inhibited during generation from the time measurement signal, the updated inhibition value is calibration value Vcal. Calibration value Vcal thus defines a replacement is value for the inhibition value. In a second case where the periodic calibration signal is derived from the inhibited internal periodic signal, calibration value Vcal is then a correction value of the initial inhibition value such that the updated inhibition value is equal to the addition of the initial inhibition value plus the calibration value (it will be noted that, in this second case, the calibration value may be positive or negative).

In the case of a temperature compensated oscillator, the aforementioned calibration value Vcal determines or corrects the constant coefficient e of a mathematical relation for inhibition value Vinh (T)=f(T)+e as follows: In a first case where the periodic calibration signal was not inhibited during generation from the time measurement signal, calibration value Vcal is an instantaneous value for Vinh (T), i.e. an updated inhibition value for a current temperature Tcur measured by a temperature sensor arranged inside the watch during implementation of the method according to the invention. Thus, Vcal=Vinh (Tcur)=f(Tcur)+$e_1$ where $e_1$ is the updated constant inhibition coefficient. In a first variant, a value Vinit (Tcur) is computed, which is an initial inhibition value computed by the relation Vinit (Tcur)=f (Tcur)+$e_0$ where $e_0$ is the previously stored constant inhibition coefficient (i.e. the initial value of this coefficient). Then, the calculation Vcor=Vcal−Vinit (Tcur)=$e_1$−$e_0$ is performed. Thus, Vcor is a correction value for the constant inhibition coefficient and an updated/replacement value $e_1$=Vcor+$e_0$ is obtained for the constant inhibition coefficient. In a second variant, it is only possible to calculate f(Tcur) and thus the replacement value $e_1$=Vcal−f(Tur) is obtained for the constant inhibition coefficient. In a second case where the periodic calibration signal is derived from the inhibited internal periodic signal, calibration value Vcal is thus an instantaneous correction value for Vinh(T). Indeed, in this case, calibration value Vcal=Vinh (Tcur)−Vinit(Tcur)=$e_1$−$e_0$, et $e_1$=Vcal+$e_0$.

Thus, in the case of a temperature compensated oscillator, the calibration parameter determined in method step ET1 determines an offset for correcting the constant term or coefficient e of the mathematical relation giving the inhibition value as a function of temperature.

In the case where the periodic calibration signal is derived from the internal periodic signal that has been inhibited, the method according to the invention may also include an initial step ET0 consisting in deactivating the adjustment circuit of the electronic device so that the internal signal is momentarily not inhibited. This preliminary step prevents taking into account a previously stored constant inhibition parameter and the time zones where it occurs, or the inhibition period, in the computation of the constant inhibition parameter in step ET2. Step ET2 is thus performed more easily and more quickly, because the calibration signal is then regular and thus easier to process.

According to an implementation of the method of the invention, step ET1 includes the following steps, consisting in:

ET1A1: between the first external pulse and the second external pulse, counting a number Ca of calibration signal periods, and ET1A2: computing the calibration parameter by dividing the reference number Nref by the number of counted periods Ca.

In this embodiment, the offset measurement between the calibration signal period and the reference period provided by the clock reference is produced directly from the calibration signal. The technical means required for implementation, in this case a single counter arranged to count the calibration signal periods, are sufficient to obtain the desired precision, as will be seen below.

According to another implementation of the method of the invention, step ET1 includes the following steps, consisting in:

ET1B1: counting, between the first external pulse and the second external pulse, a first number Cb1 of periods of a high frequency signal HF, ET1B2: counting a second number Cb2 of periods of signal HF between a third internal pulse and a fourth internal pulse separated by a calibration time Tcal corresponding to the reference number Nref of periods of calibration signal Pcal, and ET1B3: computing the calibration parameter by dividing the second number counted Cb2 by the first number counted Cb1.

In this embodiment, a high frequency signal HF is used to measure the offset between the calibration signal period and the reference period provided by the clock reference. The technical means required for implementation, in this case a high frequency generator and a counter, are thus slightly more substantial, but they make it possible to obtain a result with the desired precision more quickly, as will be explained in detail below.

According to yet another implementation of the method of the invention, step ET1 includes the following steps, consisting in:

ET1C1: determining the actual duration Phf of a period of a high frequency signal HF, generated by an HF generator internal to the electronic watch between two pulses provided by the internal time base or the external system, ET1C2: between the first external pulse and an active edge of the calibration signal following the first external pulse, counting a first number Cc1 of periods of signal HF, and deducing therefrom a first time lag T1 between the first external pulse and the active edge of the calibration signal following the first external pulse (T1=Phf×Cc1), ET1C3: between the first external pulse and the second external pulse, counting a number Cc2 of periods of the calibration signal Pcal, ET1C4: between the second external pulse and an active edge of the calibration signal following the second external pulse, counting a second number Cc3 of periods of signal HF, and deducing therefrom a second time lag T3 between the second external pulse and the active edge of the calibration signal following the second external pulse (T3=Phf×Cc3), ET1C5: determining the calibration parameter M by the relation M=((Tm−T1+T3)/Cc2)/Pref where Tm is the measurement time between the first external pulse and the second external pulse, T1 is the first time lag, T3 is the second time lag, Cc2 is the number of calibration signal periods counted in the measurement time during step ET1C3 and Pref is the reference period for the calibration signal.

In a variant, step ET1C1 can include the following sub-steps, consisting in:

ET1C11: measuring a test time by counting a test number N0 of calibration signal periods, and producing a fifth test pulse and a sixth test pulse at the beginning and end of the test time measurement, ET1C12: between the fifth test pulse and the sixth test pulse produced in step ET1C11, counting a third number Cc4 of periods of signal HF, and ET1C13: calculating the duration Phf of the period of signal HF by the relation Phf=Pref×N0/Cc4, where Pref is the duration of a reference period, N0 is the test number and Cc4 is the third number counted in step ET1 C12.

The invention also concerns an electronic device for a watch, an electronic device which is adapted for implementation of a method as described above. The electronic device is characterized in that, in addition to the time base and the adjustment circuit described above, it also includes a self-calibration circuit arranged to determine, from a first external pulse and a second external pulse received from an external system and separated by a measurement time Tm corresponding to a reference number Nref of reference periods Pref for a periodic calibration signal Scal derived from time measurement signal Sosc and having a calibration frequency Fcal equal to the natural frequency or to a predetermined fraction of the natural frequency, a calibration parameter representative of a ratio between a calibration period equal to the inverse of the calibration frequency and the reference period, and then to determine a value of the constant inhibition parameter as a function of the calibration parameter, the reference period and the predefined inhibition period.

Additional features of the method for determining a constant parameter of an inhibition value according to the invention and of the electronic device according to the invention are mentioned in the dependent claims and can be taken individually or in all possible combinations.

As will be detailed in the following description, the invention can be implemented simply by using electronic devices that are already present inside a watch, the only indispensable external elements being two pulses which must be provided to the watch by an external reference time base. Thus, the invention is particularly advantageous since it requires very few means for implementation.

BRIEF DESCRIPTION OF THE DRAWINGS

The invention will be described in more detail below with reference to the annexed drawings, given by way of non-limiting example, in which.

DETAILED DESCRIPTION OF THE INVENTION

Figure 1:
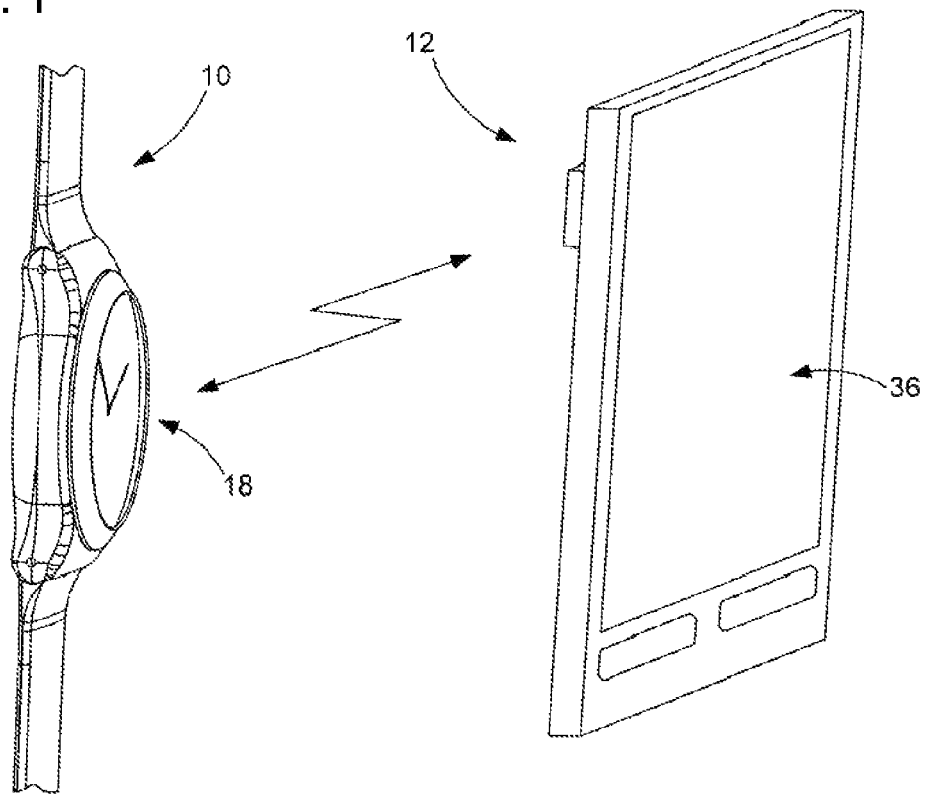
FIG. 1 represents a perspective view of an electronic watch and an electronic device used to implement a method according to the invention.

Referring to FIG. 1, electronic watch 10 includes a time display device 18, in the example represented an analogue display device including hands driven by a stepping motor (not represented). In a variant, the display is device may be of the digital type.

The watch also includes an electronic device 20 including a signal receiver 16. Signal receiver 16 is configured to communicate with an external system 12. The communication between signal receiver 16 and the watch and external system 12 can be envisaged by any known means, for example, via an optical link, a wired electrical connection, a magnetic connection via magnetic signals generated by a coil, a radio frequency link, etc.

Signal receiver 16 is configured to receive from external system 12 an external signal containing at least two pulses separated by a measurement time Tm, to extract the pulses from the external signal and to transmit the pulses. According to one embodiment, the external signal received by the signal receiver is a periodic signal with a very precise frequency. This is the case, for example, if the external system is a rubidium atomic clock transmitting an external periodic signal with a precise frequency or if the external system is a member of a satellite constellation (Galileo, GPS, Glonass, etc.) transmitting a periodic signal with a precise frequency. In these cases, the signal receiver is configured to extract from the periodic external signal two pulses separated by time Tm, the two pulses correspond to active edges of the external periodic signal and the two pulses may or may not be successive. According to another embodiment, the external signal is a signal having only two pulses and signal receiver 12 is configured to extract the two pulses from the external signal. This is the case, for example, if the external system is a device comprising a very precise clock (e.g. a measuring apparatus equipped with an atomic clock) or if the external system includes an external device (e.g. a consumer device such as a smartphone 36—FIG. 1) coupled to a satellite network to receive a periodic signal with a precise frequency.

Figure 2:
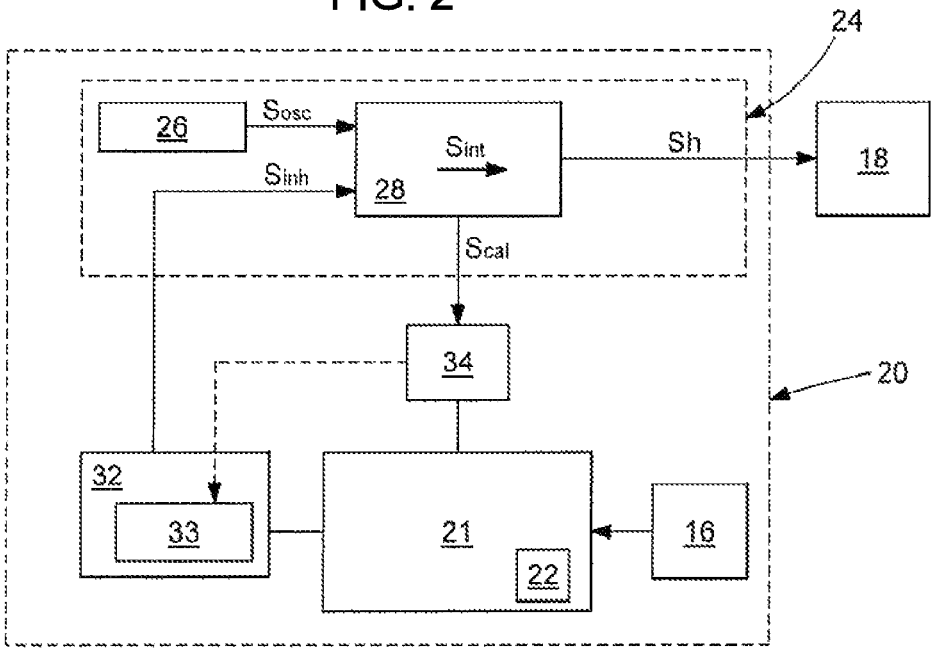
FIG. 2 represents a block diagram of an electronic device of a watch according to FIG. 1, FIGS. 3A-3C, 4A-4D, 5A-5G represent timing diagrams representative of modes of implementing the method according to the invention.

FIG. 2 represents in detail the electronic watch device including signal receiver 16, a microcontroller 21 and an internal time base 24.

Internal time base 24 includes an oscillator 26, for example a quartz oscillator, which provides a periodic time-measurement signal Sosc with a determined natural frequency Fosc, and a clock circuit 28 arranged downstream of oscillator 26, which receives signal Sosc at a first input and which provides at a first output a clock signal Sh at the operating frequency Fhor of the electronic watch.

According to one embodiment (not illustrated in detail), the clock circuit is a frequency divider 28 formed of 15 divide-by-two stages in cascade, thus allowing a signal Sosc with a frequency approximately equal to 32,768 Hz to change to a signal Sh with a frequency substantially equal to $Fhor=32,768/(2^{15})=1$ Hz. This signal Sh is sent to the coil terminals of the stepping motor of the watch display device, in order to drive the hands of the time display device. According to another embodiment, the clock circuit is a divider-by-4 circuit, formed of two divide-by-2 stages in cascade. Signal Sh produced by the internal time base in this case has a frequency Fhor substantially equal to $32,768/(2^2)=8,192$ Hz.

The clock circuit also produces an internal periodic signal Sint derived from time-measurement signal Sosc. This internal signal Sint occurs in the generation of clock signal Sh.

Electronic device 20 also includes a circuit 32 for adjusting the mean operating frequency of the electronic watch. Adjustment circuit 32 includes, in particular, a memory 33 configured to store at least one constant vale for the inhibition value (or a constant inhibition parameter) and more generally coefficients of a polynomial with temperature as a variable and defining an inhibition value that varies with temperature. Adjustment circuit 32 provides an inhibition signal Sinh to a second input of clock circuit 28.

Adjustment circuit 32 acts on an internal signal Sint* in the clock circuit. In the example of a clock circuit formed of a frequency divider having 15 divide-by-two stages, adjustment circuit 32 preferably acts between the output of the first stage and the input of the second stage of the frequency divider circuit, on internal signal Sint* with a frequency close to 16,384 Hz derived from signal Sosc which has a frequency close to 32,768 Hz for a quartz oscillator. A programmed number of pulses at the second stage input of divider circuit 28 is, for example, removed every 60 seconds, corresponding to an inhibition period Cinh, to form internal signal Sint which is thus an inhibited internal signal, whereas signal Sint* which corresponds thereto outside the inhibition time zones is thus a non-inhibited internal signal. It will be noted that, if the adjustment circuit is deactivated, signals Sint* and Sint are then the same and have exactly the same frequency. A frequency of 16,384 Hz corresponds to a period Pint of 1/16,384=61,035 μs. Returned to the 60 second inhibition period, the inhibition adjustment resolution is thus equal to Pint/Cinh=61,035 μs/60 s= $1,017\times10^{-6}=1,017$ ppm (parts per million), which is equal to 0.888 seconds per day.

According to the invention, the internal time base also produces a calibration signal Scal derived from time-measurement signal Sosc produced by the oscillator and with a frequency Fcal. In the examples described below with reference to FIGS. 3A-3C, 4A-4D and 5A-5G, the calibration signal is derived from internal signal Sint* available at the output of the first frequency divider stage and it is defined by this signal Sint*. Thus, in the example considered, its frequency Fcal is equal to Fosc/2, i.e. close to 16,384 Hz. In other examples, the calibration signal can be equal to signal Sosc produced by the oscillator, or equal to signal Sh produced by the clock circuit, or even equal to any other signal derived from time-measurement signal Sosc with a frequency that is a fraction of natural frequency Fosc. If necessary, during implementation of the method, account will be taken of the ratio between the calibration signal frequency Fcal and the internal frequency of the (non-inhibited) internal signal Sint* on which the adjustment circuit acts. In the context of the invention, the calibration signal is used to measure a value representative of the difference between period Posc of time measurement signal Sosc and a corresponding set signal.

According to the invention, the electronic watch device also includes a self-calibration circuit 34 configured to determine a constant inhibition parameter for adjusting the mean operating frequency of the electronic watch, by implementing a method according to the invention including the following steps, consisting in:

ET1: from a first external pulse and a second external pulse received from a system external to the watch and separated by a measurement time (Tm) corresponding to a reference number (Nref) of reference periods (Pref) for a periodic calibration signal (Scal) derived from the time-measurement signal (Sosc) and having a calibration frequency (Fcal) derived from the natural frequency of the oscillator, determining a calibration parameter (M) representative of a ratio between a calibration period (Pcal) equal to the inverse of the calibration frequency (Fcal) and the reference period (Pref), and ET2: determining a constant inhibition parameter as a function of the calibration parameter.

In the following examples, the calibration parameter is chosen to be equal to the ratio Pcal/Fret the calibration parameter is thus a measurement of the watch calibration signal period Pcal with respect to reference period Pref. If the calibration signal is derived directly from time-measurement signal Sosc (without being subjected to action by the adjustment circuit), then the calibration signal period is a multiple of the period of signal Sosc produced by the oscillator and the calibration period is a measurement of the period of signal Sosc with respect to the corresponding set period. It will be recalled that the period of a signal is the inverse of the frequency of said signal, such that Fref/Fcal=Pcal/Pref.

In the following examples, the determination of the constant inhibition parameter (ET2) from the calibration parameter is not explained in detail, since this was explained above.

Finally, for the sake of simplification, in all the numerical examples that follow:

- the oscillator has a natural frequency Fosc close to a set frequency equal to 32,768 Hz,
- the oscillator is not temperature compensated, so that the constant inhibition parameter is the constant inhibition value to be stored in the adjustment circuit,
- the calibration signal has a frequency Fcal equal to the frequency Fint of the (non-inhibited) internal signal Sint* on which the adjustment circuit will act, equal to Fosc/2, and thus close to 16,384 Hz; thus, for such a calibration signal, the reference period Fref=1/16,384=61,03516 μs, and the reference number Nref=16,384×Tm, where Tm is the measurement time (these numerical values are evidently simply non-limiting examples of the more general scope of the invention).

Reference number Nref and/or measurement time Tm can be stored in a memory of the self-calibration circuit. In a variant, the reference number and/or the measurement time can be provided to the watch by the external system (reference clock or external device coupled to a reference clock), especially before the first external pulse or after the second external pulse.

In a first example implementation of the invention, step ET1 includes the following steps, consisting in:

- ET1A1: between the first external pulse and the second external pulse, counting a number Ca of calibration signal periods, and
- ET1A2: computing the calibration parameter by dividing the reference number Nref by the number of counted periods Ca.

Figures 3A, 3B, 3C, 4A, 4B, 4C, 4D:
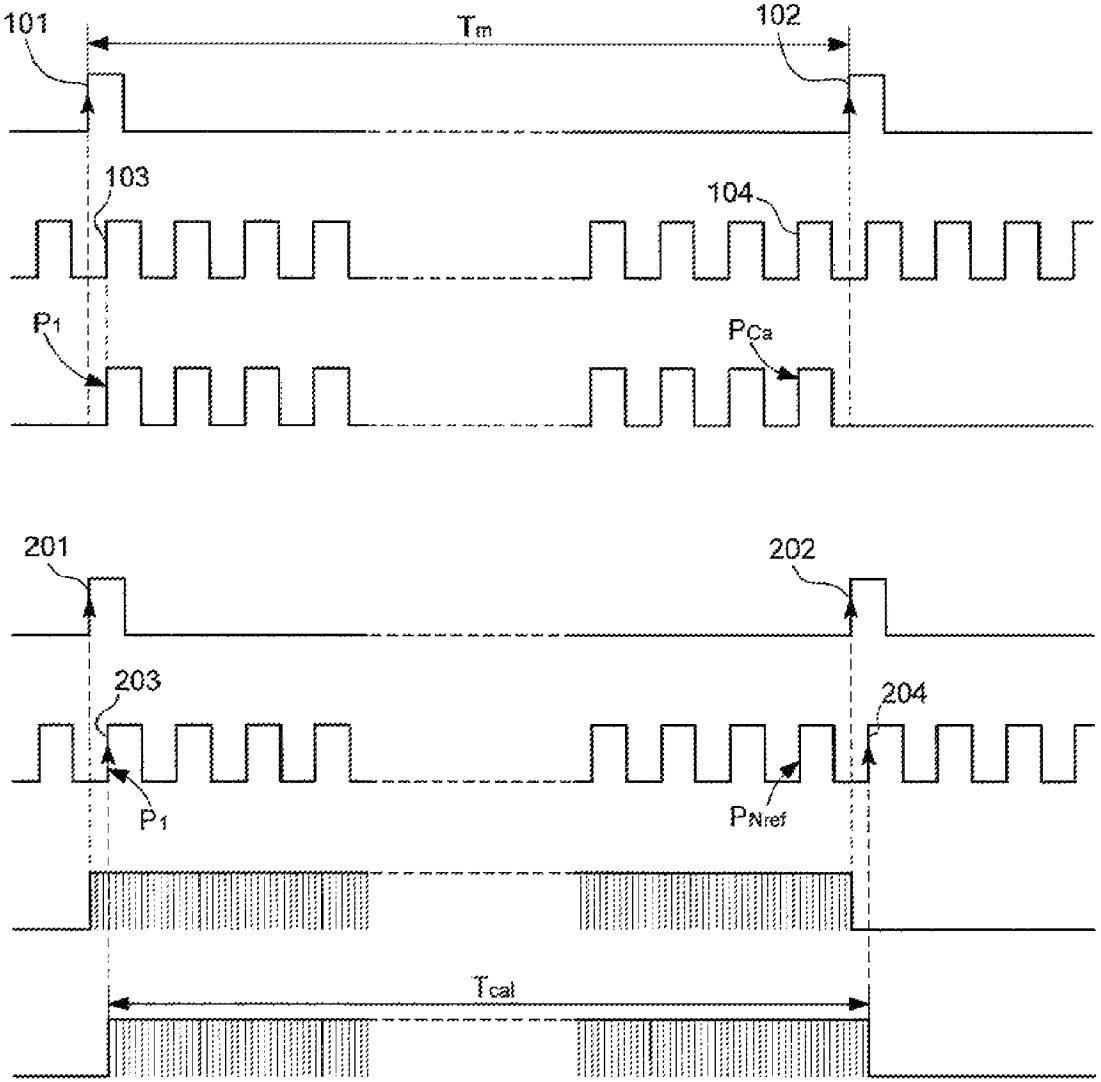

In an operational implementation, step ET1A1 is performed with a is counter operating in a conventional manner as illustrated by the timing diagrams of FIGS. 3A-3C: on a first rising edge 101 (first external pulse) of the external signal (FIG. 3A), the counter is activated and counts the active edges (here the rising edges from 103 to 104) of the calibration signal (FIG. 3B), on a second rising edge 102 (second external pulse) of the external signal, the counter produces a number Ca of calibration signal periods counted (FIG. 3C) from the start of a period $P_1$ to the end of a period $P_{Ca}$.

In the numerical example chosen (Fref=16,384 Hz), if the measurement time is chosen to be equal to 1 second, the number Nref of reference periods is equal to Nref=16,384. If, between the two external pulses 101, 102 (rising edges) separated by Tm=1 second, the counter counts Ca=16,386 periods, then the calibration signal frequency is equal to Fcal=16,386 Hz, i.e. a slightly higher calibration frequency Fcal derived from the natural oscillator frequency than reference frequency Fref. Period Pcal of the calibration signal is equal to 1/16,386=61.0277 μs. The watch calibration period M, which corresponds here to the relative value of the oscillator period with respect to its set period, is equal to M=Pcal/Pref=Nref/Ca=16,384/16,386=0.9998779, and the relative error over the period is equal to 1−M, i.e. $122\times10^{-6}$=122 ppm. In other words, the calibration period is 122 ppm shorter than the reference period.

In this implementation, measurement of the difference between the natural period of the oscillator and the associated set period is performed exclusively by counting the periods of the calibration signal derived from signal Sosc, i.e. in the example a calibration signal with a frequency Fcal=16,384 Hz ($2^{14}$ Hz), with oscillator precision close to 100 ppm. The measurement resolution is thus equal to the duration of one period (very close to $1/2^{14}$ second) of the calibration signal whose pulses are counted, divided by the measurement time. Thus, for a measurement time of 1 second, the measurement resolution is on the order of $(1/2^{14})/1$ s=61 ppm=1925 seconds per year. For a measurement duration of 100 seconds, the resolution is improved by a factor of 100 i.e. $(1/2^{14})/100$ s=0.61 ppm=19.25 seconds per year. For a measurement duration of 3600 seconds (i.e. 1 hour), the resolution is improved by a factor of 3600 i.e. $(1/2^{14})/3600$ s=16.95 ppm=0.535 seconds per year. It is therefore noted that, in this first embodiment, a measurement period on the order of an hour is required to achieve a resolution of 0.535 seconds per year, on the order of magnitude of the resolution of an inhibition adjustment circuit, which is, for example, around 0.1175 seconds per year for a high precision watch.

In a second example implementation of the invention, step ET1 includes the following steps, consisting in:

- ET1B1: counting, between first external pulse 201 and second external pulse 202, a first number Cb1 of periods of a high frequency signal HF,
- ET1B2: counting a second number Cb2 of periods of signal HF between a third internal pulse 203 and a fourth internal pulse 204 separated by a calibration time Tcal corresponding to the reference number Nref of periods of calibration signal Pcal and computed from the start of a first pulse $P_1$ to the end of a pulse $P_{Nref}$ of the periodic calibration signal (see FIG. 4B) which shows the periodic calibration signal and the pulses concerned), and
- ET1B3: computing the calibration parameter by dividing the second number counted Cb2 by the first number counted Cb1.

In an operational implementation, steps ET1B1 and ET1B2 are performed using at least one counter and a high frequency generator, described in detail below.

In an example, the HF generator can produce a signal HF with a frequency of 1 MHz, i.e. a frequency around 60 times higher than the frequency of the watch calibration signal. The absolute resolution of such an HF generator is equal to a period of signal HF divided by the total measurement time. Thus, for a measurement in 1 second, the resolution is is equal to $(1/10^6)/1$ s=1 ppm, which corresponds to a resolution of 31.536 seconds per year. If the measurement is extended over 100 s, the resolution is divided by 100 namely $(1/10^6)/100$ s=0.01 ppm namely 0.315 seconds per year. If the measurement lasts 300 seconds (i.e. 5 minutes), the resolution reaches $(1/10^6)/300$ s=0.00333 ppm namely 0.105 seconds per year, which is very close to the intrinsic resolution of the adjustment circuit (0.1175 seconds per year). The use of the HF generator instead of the quartz oscillator thus achieves at least as good precision as in the preceding embodiment and in a much shorter time.

First step ET1B1 is in a way a calibration step of HF generator 22, by measuring the actual frequency Fhf of the HF generator at the moment of measurement. This takes into account the low precision and instability of the HF generator. Second step ET1B2 is thus a measurement of the actual frequency of the quartz oscillator of the electronic watch device. Finally, third step ET1B3 determines the calibration parameter.

In a numerical example, during step ET1B1, a number Cb1=1,050,000 periods Phf of signal HF is counted in measurement time Tm=1 second defined by the first and second external pulses 201, 202 separated by measurement time Tm=Nref×Pref=Cb1×Phf. During step ET1B2, a number Cb2=1,049,911 is counted in calibration time Tcal defined by the third and fourth pulses 203, 204 separated by calibration time Tcal=Nref×Pcal=Cb2×Phf. Since Cb2/Cb1=1,049,911/1,050,000=0.999915238, the calibration time is shorter than the measurement time; it follows that the quartz oscillator period is slightly shorter than the intended set period of this oscillator. It is therefore necessary to "slow down" the internal time base by inhibition. Calibration parameter M is equal to Cb2/Cb1=0.999915238 and the relative error over the period is equal to 1−Cb2/Cb1=1−0.999915238=0.00008476 namely 84.76 ppm.

In the above example, the measurement was made over a period Tm=1 second. In a variant, the measurement can be made over a longer measurement time, for example, Tm=10 seconds, to gain a factor 10 in accuracy.

In another variant, steps ET1B1 to ET1B3 can be repeated several times (possibly with different measurement times), for example repeated 100 times for a measurement time of between 1 and 2 seconds. A measurement time of 1 to 2 seconds is sufficiently short for the HF generator to be stable over the measurement time. In this case, ratio Cb/Cb1 will be systematically measured at the end of each step ET1B3 and then a mean (Cb2/Cb1)moy of the ratios (Cb2/Cb1) computed in the successive steps ET1B3 will be calculated (step ET4) to determine a mean value of the calibration parameter and then the mean correction to be made (1−(Cb2/Cb1)moy). This also improves accuracy, owing to the fact that the HF generator is recalibrated more frequently, which reduces the impact of any lack of stability.

Steps ET1B1 and ET1B2 can be performed simultaneously, in which case the self-calibration circuit has two counters, both clocked by signal HF provided by a high frequency generator of the electronic watch device, for example the microcontroller clock. One of the counters is activated/deactivated by the external reference signal and the other counter is activated/deactivated by the watch calibration signal. In a variant, steps ET1 B1 and ET1B2 are performed in succession (cf. timing diagrams 4*a*-4*d*) by a single counter clocked by the high frequency signal HF, in which case the result Cb1 of the 1st count (step ET1B1) is temporarily stored to be used (step ET1B3) at the end of the second count Cb2 (step ET1B2).

In a third example implementation of the invention, calibration parameter determination step ET1 includes the following steps, consisting in:

- ET1C1: determining the actual duration Phf of a period of a high is frequency signal HF generated by an HF generator internal to the electronic watch between two pulses provided by the internal time base or the external system,
- ET1C2: between the first external pulse and an active edge of the calibration signal following the first external pulse, counting a first number Cc1 of periods of signal HF, and deducing therefrom a first time lag T1 between the first external pulse and the active edge of the calibration signal following the first external pulse: T1=Phf×Cc1,
- ET1C3: between the first external pulse 301 and the second external pulse 302, counting a number Cc2 of periods of the calibration signal Pcal,
- ET1C4: between second external pulse 302 and an active edge 304 of the calibration signal following second external pulse 302, counting a second number Cc3 of periods of signal HF, and deducing therefrom a second time lag T3 between second external pulse 302 and active edge 304 of the calibration signal following the second external pulse: T3=Phf×Cc3,
- ET1C5: determining the calibration parameter M by the relation M=((Tm−T1+T3)/Cc2)/Pref where Tm is the measurement time between first external pulse 301 and second external pulse 302, T1 is the first time lag, T3 is the second time lag, Cc2 is the number of calibration signal periods counted in measurement time Tm during step ET1C3 and Pref is the reference period for the calibration signal.

In the example represented in FIGS. 5A-5F, step ET1C1 includes the following sub-steps, consisting in:

- ET1C11: measuring a test time by counting a test number (N0=10) of calibration signal periods, and producing a fifth test pulse 305 and a sixth test pulse 306 respectively at the beginning and end of the test time measurement,
- ET1C12: between fifth test pulse 305 and sixth test pulse 306 produced in step ET1C11, counting a third number Cc4 of periods of signal HF, and
- ET1C13: calculating the duration Phf of the period of signal HF by the relation Phf=Pref×N0/Cc4, where Pref is the duration of a reference period, N0 is the test number and Cc4 is the third number counted in step ET1C12.

In a numerical example, the external system (reference clock) provides (FIG. 5A) two external pulses 301 and 302, separated by measurement time Tm, which is 10 seconds in the example. The calibration signal (FIG. 5B) with frequency Fcal (in the example on the order of 16,384 Hz) derived from the quartz oscillator frequency, is the signal whose period is to be exactly determined relative to the reference period.

In step ET1C2, the periods of signal HF are counted between the first external pulse (rising edge 301) and a rising edge 303 following the calibration signal separated by first time lag T1 and at most one period of the calibration signal, i.e. a maximum of 1/16384=61.035 μs. If signal HF at 1 MHz is accurate to within 10%, the duration of 61.035 μs translates to a maximum of 67 periods of signal HF. In a numerical example, Cc1=50.

Figures 5A, 5B, 5C, 5D, 5E, 5F, 5G:
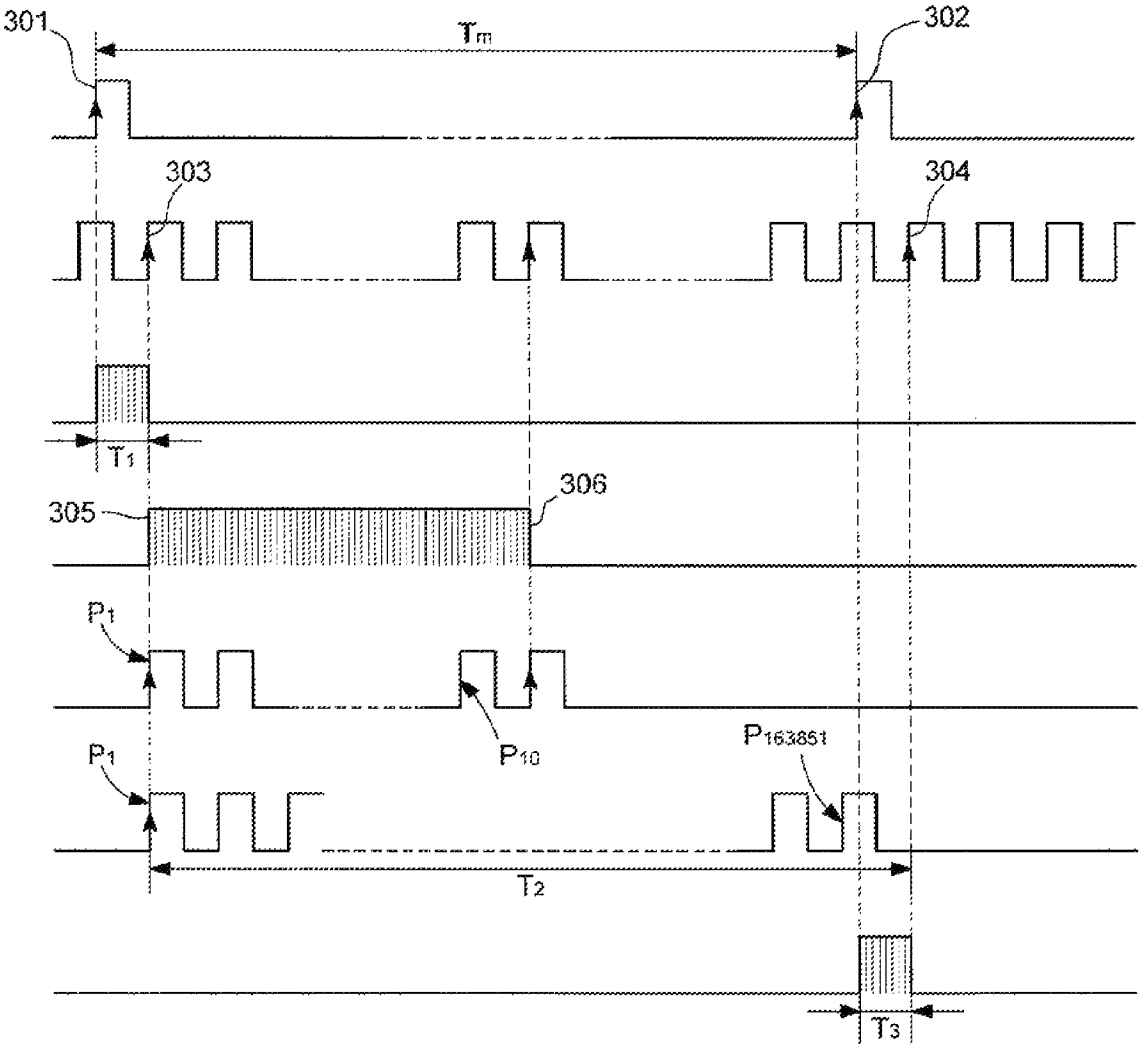

In step ET1C3, the calibration signal periods are counted (Cc2) between the two external pulses (rising edges 301, 302) separated by measurement time Tm. In FIG. 5F, the start of a calibration signal period is indicated by a rising edge, and all the calibration signal periods started between the first external pulse and the second external pulse are counted. In a numerical example, Cc2=63851.

In step ET1C11 (FIG. 5E), a test number N0 of calibration signal periods are counted a fifth test pulse 305 and a sixth test pulse 306 are produced at the start and end of the counting of number N0. In step ET1C12 (FIG. 5D), between fifth pulse 305 and sixth pulse 306, a third number Cc4 of periods of signal HF is counted. Steps ET1C11 and ET1C12 can be performed in parallel, with the pulses produced in step ET1C11 activating and deactivating the counting performed in step ET1C12. In the example represented in FIGS. 5D, 5E, N0=10 calibration signal periods are counted between active edge P1 of row 1 and active edge P11 of row P11, the active edge of row P1 being here the first active edge 303 of the calibration signal after the first external pulse (active edge 301). Number N0 can be different, for example equal to 50 or 100. It must be sufficient for the desired accuracy for measuring the period of signal HF. The N0 periods could also be counted between the active edges of rows 2 and 12, or 3 and 13, etc. It is preferable, however, to perform step ET1C1 (including steps ET1C11 to ET1C13) just before or just after step ET1C2, in order to take the best possible account of the low precision and any temperature drift of the HF generator during the performance of step ET1C2.

In a numerical example, N0=10 and Cc4=665. In a first approximation, the duration of a calibration signal period with frequency Fcal (very close to Fref) is equal to the duration Pref of a reference signal period, namely 1/16384=61,0352 μs, and N0 periods have a duration of 610.352 μs. Duration Phf of a period of signal HF is thus equal to Phf=610.352/665=0.9178 μs, namely a frequency of 1.089 MHz. It will be noted that the above approximation is sufficient to obtain the desired final accuracy. Indeed, duration N0×Pref is known with uncertainty on the frequency of the signal delivered by the quartz oscillator, which uncertainty is, by design of the quartz oscillator, comprised between 0 and 200 ppm. This uncertainty is negligible compared to the resolution of the high frequency count over N0 calibration signal periods since, for a count at 1 MHz over N0=10 periods of a signal at 16,384 Hz corresponding to a duration of 10×(1/16384)=610 μs, the uncertainty is equal to $10^{-6}/610\times10^{-6}=0.001639$, namely 1639 ppm. The resolution of the high frequency count over N0 periods of the internal clock signal is itself negligible compared to the resolution of the high frequency count over a single period of the calibration signal; indeed, for a count at 1 MHz over 1 period of a signal at 16,384 Hz corresponding to a duration of 1×(1/16384)=61 μs, the uncertainty is equal to $1/67=0.0147$ namely 14700 ppm, 67 being the maximum number of periods counted between rising edge 101 of the reference signal and rising edge 102 of the internal clock signal in step ET1C2.

In step ET1C4, the periods of signal HF are counted between the second external pulse (rising edge 302) and a rising edge 304 following the calibration signal separated by second time lag T3 and at most one period of the calibration signal, i.e. a maximum of 1/16384=61 μs. If signal HF at 1 MHz is accurate to within 10%, the duration of 61 μs translates to a maximum of 67 periods of signal HF. In a numerical example, Cc3=53, corresponding to a time lag T3. For the sake of accuracy, step ET1C1 can be repeated (not represented in FIGS. 5A-5F) just before or just after step ET1C4, in order to take account of any drift of period Phf of signal HF between the first pulse 301 and second pulse 302 of the reference signal.

The actual period Phf=0.9178 μs of signal HF obtained in step ET1C1 makes it possible to accurately determine time lags T1 and T3. T1=Cc1×Phf=50×0,9178 μs=45.9 μs, and T3=Cc3×Phf=53×0,178 μs=48.6 μs. The actual duration T2 of Cc3=163851 periods of the calibration signal can then be computed: T2=Tm−T1+T3=10 s−45.9 μs+48.6 μs=10.0000027 seconds. The duration of one period of the calibration signal is thus equal to 10.0000027/163851=61.031075 μs and the frequency of the calibration signal is equal to 163851/10.0000027=16385.0956 Hz. The calibration parameter Pcal/Pref is equal to 61.031075/61.03516=0.99993313. The relative deviation of the calibration period with respect to the reference period is equal to 1−Pcal/Pref=$66.87\times10^{-6}$=66.87 ppm. This deviation can also be computed by (16385.0956−16384)/16384=$66.87\times10^{-6}$=66.87 ppm.

The uncertainty of measurement over Tm=10 seconds is essentially produced by two times the resolution of the counter clocked by the high frequency signal HF, namely $2\times(1/10^6)/10=2\times10^{-7}$, namely 0.2 ppm. This error is proportional to measurement time Tm. Thus, choosing Tm=100 seconds lowers the error to 0.02 ppm.

The invention also concerns an electronic device suitable for implementing the method described above. The electronic device includes an internal time base 24 and an adjustment circuit 32 as described above. According to the invention, the electronic device also includes a self-calibration circuit 34 arranged to determine, from a first external pulse and a second external pulse received from an external system and separated by a measurement time Tm corresponding to a reference number Nref of reference periods Pref for a periodic calibration signal Scal derived from time-measurement signal Sosc and having a calibration frequency Fcal equal to said natural frequency or to a predetermined fraction of said natural frequency, a calibration parameter representative of a ratio between a calibration period equal to the inverse of the calibration frequency and the reference period, and then to determine a value of the constant inhibition parameter as a function of the calibration parameter, the reference period and the predefined inhibition period.

The external system can be a reference clock external to the watch. The external system can also be a device external to the watch including (or coupled to) an external reference clock. The external system produces an external reference signal including at least the first external pulse and the second external pulse. The electronic device also includes a receiver circuit 16 arranged to receive the external reference signal and to transmit the first external pulse and the second external pulse to the self-calibration circuit.

In variants, self-calibration circuit 34 may also be connected to internal time base 24 of the watch in order to receive the calibration signal from oscillator 26 or from clock circuit 28. The self-calibration circuit may also be arranged to deactivate the adjustment circuit.

According to one embodiment, self-calibration circuit 34 may include a first counter. In a first variant, the first counter is arranged to count a number of periods of the calibration signal between the first external pulse and the second external pulse, to perform step ET1A1 for example. In a second variant, the first counter can be arranged to measure a predefined duration (Tcal, T0) by counting a predefined number (Nref, N0) of calibration signal periods, to measure the calibration time Tcal in step ET1B2 for example, or to measure the test period in step ET1C13 for example.

The first counter can also be arranged, when it is used to measure a duration, to produce a start of measurement pulse and an end of measurement pulse. Thus, for example when it is used to perform step ET1B2, the first counter can produce the third internal pulse 303 and the fourth internal pulse 304 respectively at the start and end of the calibration time (Tcal) measurement. Or, when it is used to perform step ET1C13, the first counter can be used to produce the fifth test pulse 305 and the sixth test pulse 304 respectively at the start and end of the test time (T0) measurement.

Also, the self-calibration circuit can include at least a second counter arranged to count periods of a high frequency signal HF. The second counter can, for example, be used to count periods of signal HF;

between the first external pulse and the second external pulse, for example to perform step ET1B1, and/or between the third external pulse and the fourth external pulse, for example to perform step ET1B2, and/or between the fifth test pulse and the sixth test pulse, for example to perform step ET1C12, and/or between the first external pulse and an active edge of the calibration signal following the first external pulse, for example to perform step ET1C2, and/or between the second external pulse and an active edge of the calibration signal following the second external pulse, for example to perform step ET1C4.

According to a variant, the self-calibration circuit may include two counters arranged to count periods of signal HF. It is thus possible to simultaneously perform two steps, for example steps ET1B1 and ET1B2, or to perform two steps in succession one after the other, such as steps ET1C2 and ET1C12 without delay.

The self-calibration circuit can also include a calculation circuit arranged to determine the calibration parameter as a function of periods counted by the first counter and/or by the second counter, according to the implementation of the method of the invention.

The electronic watch device may also include a high frequency generator HF, for example an RC oscillator, arranged to produce high frequency signal HF. Signal HF is used to clock the second counter.

According to a practical implementation, the first counter and/or the second counter and/or the HF generator of the self-calibration circuit are respectively a first counter and/or a second counter and/or an HF generator of the microcontroller.

In practice, microcontrollers used in the field of horology often have a high frequency internal oscillator, for example of the RC (resistor/capacitor) type. This is an oscillator with no external resonator, whose frequency is imprecise (generally on the order of +/−10%) and whose frequency is unstable, sensitive particularly to temperature. Such an oscillator is mainly used to run the software associated with the electronic device of the watch at a considerably higher speed than that of the quartz oscillator. The RC oscillator is generally used intermittently to save energy in the watch. It can thus also be used as a high frequency generator for an additional function, such as self-calibration of the watch according to the invention.

Timepiece microcontrollers also frequently have one or more counters able to be used to count periods or to measure durations. Since these counters are generally only occasionally used, they can also be used to implement self-calibration according to the invention.

In a practical implementation, the electronic watch device can be formed of a first integrated circuit in which are encapsulated the internal time base (24) and the adjustment circuit (32), and a second integrated circuit including the self-calibration circuit and the microcontroller.

KEY TO DRAWINGS

Sosc periodic signal produced by the oscillator
with a natural frequency Fosc (e.g. Fosc=32,772 Hz for a set frequency Fosc*=32,768 Hz
and period Posc Sint internal clock circuit signal; signal derived from signal Sosc; signal on which the adjustment circuit acts during generation of said signal;
with a non-inhibited frequency Fint
and non-inhibited period Pint Sh operating signal (or clock signal) provided by the clock circuit; with a mean operating frequency Fhor (set frequency: Fhor*, for example equal to 1 Hz or 8,192 Hz), Scal calibration signal derived from Sosc;
with frequency Fcal (e.g. Fcal=Fosc, Fosc/2 or Fint)
and period Pcal Fref, Pref: reference frequency and period which are associated with the calibration signal Nref number of reference periods Pref provided during measurement time Tm, which is determined by an external reference time base Sinh inhibition signal provided by the adjustment circuit to the clock circuit Cinh inhibition period (or cycle)

signal HF high frequency signal with frequency Fhf and period Phf

16 signal receiver circuit

18 display device

20 electronic device

21 microcontroller

22 HF generator of the microcontroller

24 internal time base

26 oscillator

28 clock circuit, for example a frequency divider

32 adjustment circuit

33 memory

34 self-calibration circuit

101, 102, 201, 202, 301, 302: pulses provided by the external system

203, 204: third and fourth internal pulses

303, 304: active edges of the calibration signal, following an active edge of the signal provided by the external clock

305, 306: test pulses provided by the calibration signal

Tm: measurement time determined by an external reference time base

Tcal: calibration time

T0: test time

The invention claimed is:

1. A method for determining a constant parameter of an inhibition value, or constant inhibition parameter, for adjusting a mean operating frequency of an electronic watch including an electronic device comprising:

an internal time base comprising a time-measurement oscillator and a clock circuit, the time-measurement oscillator having a natural frequency and being arranged to provide a periodic time-measurement signal with said natural frequency, the clock circuit being arranged to receive the periodic time-measurement signal and to generate a clock signal with the mean operating frequency, an adjustment circuit for adjusting the mean operating frequency, including a memory storing at least said constant inhibition parameter, the adjustment circuit being arranged to inhibit, by predefined inhibition period and as a function of at least the constant inhibition parameter, one or more periods in the generation of a periodic signal internal to the clock circuit involved in the generation of the clock signal, such that the mean operating frequency is more precise, the internal periodic signal being derived from the periodic time-measurement signal, the method for determining the constant inhibition parameter includes the following steps:

ET1: from a first external pulse and a second external pulse received from a system external to the watch and separated by a measurement time corresponding to a reference number multiplied by a reference period for a periodic calibration signal derived from the periodic time-measurement signal and having a calibration frequency derived from the natural frequency, determining a calibration parameter representative of a ratio between a calibration period, equal to the inverse of the calibration frequency, and the reference period, and ET2: determining the constant inhibition parameter as a function of the calibration parameter.

2. The method according to claim 1, wherein the calibration parameter determined in step ET1 makes it possible to compute a calibration value Vcal=[1−(Pcal/Pref)]·Cinh/Pint where Pcal is the calibration period, Pref is a reference period for the internal periodic signal, Pint is a period of the internal periodic signal or of a non-inhibited internal periodic signal corresponding to the internal periodic signal without inhibition or a set period for the internal periodic signal, and Cinh is the predefined inhibition period.

3. The method according to claim 2, wherein, depending on whether the periodic calibration signal is derived from the inhibited or non-inhibited internal periodic signal, calibration value Vcal is respectively either a correction value of the inhibition value for correcting the constant inhibition parameter, or an instantaneous value for the inhibition value and determines the constant inhibition parameter.

4. The method according to claim 1, wherein the constant inhibition parameter is:

in the absence of temperature compensation, the inhibition value; or a constant coefficient of a mathematical relation computing the inhibition value as a function of temperature.

5. The method according to claim 1, wherein the periodic calibration signal is derived from a non-inhibited internal periodic signal corresponding to the internal periodic signal without inhibition, and wherein the method also includes an initial step of deactivating the adjustment circuit.

6. The method according to claim 1, wherein the step ET1 of determining the calibration parameter includes the following steps:

ET1A1: between the first external pulse and the second external pulse, counting a number of calibration periods of the periodic calibration signal, and ET1A2: computing the calibration parameter by dividing the reference number by the number of calibration periods.

7. The method according to claim 1, wherein the step ET1 of determining the calibration parameter includes the following steps:

ET1B1: counting, between the first external pulse and the second external pulse, a first number of periods of a high frequency HF signal, generated by an HF generator internal to the electronic watch, ET1B2: counting a second number of periods of the high frequency HF signal between a third internal pulse and a fourth internal pulse separated by a calibration time corresponding to the reference number multiplied by the calibration period, and ET1B3: computing the calibration parameter by dividing the second number of periods by the first number of periods.

8. The method according to claim 7, wherein steps ET1B1 and ET1B2 are performed simultaneously or in succession, the counting of step ET1B1 being temporarily stored to be used in step ET1B3.

9. The method according to claim 7, wherein steps ET1B1 to ET1B2 are repeated several times and then, in a step ET1B4, a mean of the calibration parameters computed in the successive steps ET1B3 is calculated to determine a mean value of the calibration parameter.

10. The method according to claim 1, wherein the step ET1 of determining the calibration parameter includes the following steps:

ET1C1: determining a duration Phf of a period of a high frequency HF signal, generated by an HF generator internal to the electronic watch between two pulses provided by the internal time base or the external system, ET1C2: between the first external pulse and an active edge of the calibration signal following the first external pulse, counting a first number of periods of the high frequency HF signal, and deducing therefrom a first time lag between the first external pulse and the active edge of the periodic calibration signal following the first external pulse, ET1C3: between the first external pulse and the second external pulse, counting a number of calibration periods of the periodic calibration signal, ET1C4: between the second external pulse and an active edge of the calibration signal following the second external pulse, counting a second number of periods of the high frequency HF signal, and deducing therefrom a second time lag between the second external pulse and the active edge of the calibration signal following the second external pulse, ET1C5: determining the calibration parameter by the relation M=((Tm−T1+T3)/Cc2)/Pref where Tm is the measurement time between the first external pulse and the second external pulse, T1 is the first time lag, T3 is the second time lag, Cc2 is the number of calibration periods counted in the measurement time during step ET1C3 and Pref is the reference period for the calibration signal.

11. The method according to claim 10, wherein step ET1C1 includes the following sub-steps:

ET1C11: measuring a test time by counting a test number of calibration periods, and producing a fifth test pulse and a sixth test pulse respectively at the beginning and end of the test time measurement, ET1C12: between the fifth test pulse and the sixth test pulse produced in step ET1C11, counting a third number of periods of the HF signal, and ET1C13: calculating the duration of the period of the HF signal by the relation Phf=Pref×N0/Cc4, where Pref is the duration of a reference period, N0 is the test number and Cc4 is the third number counted in step ET1C12.

12. The method according to claim 11, wherein steps ET1C11 and ET1C12 are performed simultaneously.

13. The method according to claim 11, wherein step ET1C1 is performed just before or just after step ET1C2.

14. The method according to claim 10, wherein step ET1C1 is repeated just before or just after step ET1C4.

15. An electronic device incorporated in an electronic watch for implementing a method according to claim 1, comprising:

an internal time base comprising a time-measurement oscillator and a clock circuit, the time-measurement oscillator having a natural frequency and being arranged to provide a periodic time-measurement signal with said natural frequency, the clock circuit being arranged to receive periodic time-measurement signal and to generate a clock signal with the mean operating frequency, an adjustment circuit for adjusting the mean operating frequency, including a memory storing at least said constant inhibition parameter, the adjustment circuit being arranged to inhibit, by predefined inhibition period and as a function of at least the constant inhibition parameter, one or more periods in the generation of a periodic signal internal to the clock circuit involved in the generation of the clock signal, such that the mean operating frequency is more precise, the internal periodic signal being derived from the periodic time-measurement signal, wherein the electronic device also includes a self-calibration circuit arranged to determine, from a first external pulse and a second external pulse received from an external system and separated by a measurement time corresponding to a reference number multiplied by a reference period for a periodic calibration signal derived from the periodic time-measurement signal and having a calibration frequency equal to said natural frequency or to a predetermined fraction of said natural frequency, a calibration parameter representative of a ratio between a calibration period equal to the inverse of the calibration frequency and the reference period, and then to determine a value of the constant inhibition parameter as a function of the calibration parameter, the reference period and the predefined inhibition period.

16. The electronic device according to claim 15, also comprising a circuit for receiving an external reference signal comprising at least the first external pulse and the second external pulse, the receiver circuit being arranged to receive the external reference signal and to transmit the first external pulse and the second external pulse to the self-calibration circuit.

17. The electronic device according to claim 15, wherein the self-calibration circuit is connected to the internal time base of the electronic watch in order to receive the periodic calibration signal from the time-measurement oscillator or from the clock circuit.

18. The electronic device according to claim 15, wherein the self-calibration circuit is also arranged to be able to deactivate the adjustment circuit.

19. The electronic device according to claim 15, wherein the self-calibration circuit includes a first counter arranged to count a number of calibration periods of the periodic calibration signal between the first external pulse and the second external pulse or to measure a predefined duration by counting a predefined number of calibration periods.

20. The electronic device according to claim 19, wherein the first counter is also arranged:

to produce a third internal pulse and a fourth internal pulse respectively at the start and at the end of a measurement of a calibration time, or to produce a fifth test pulse and a sixth test pulse respectively at the start and at the end of a measurement of a test time.

21. The electronic device according to claim 20, wherein the self-calibration circuit also includes at least a second counter arranged to count periods of a high frequency HF signal:

between the first external pulse and the second external pulse, and/or between the third internal pulse and the fourth internal pulse, and/or between the fifth test pulse and the sixth test pulse, and/or between the first external pulse and an active edge of the periodic calibration signal following the first external pulse, and/or between the second external pulse and an active edge of the periodic calibration signal following the second external pulse.

22. The electronic device according to claim 21, wherein the self-calibration circuit also includes a calculation circuit arranged to determine the calibration parameter as a function of periods counted by the first counter and/or by the second counter.

23. The electronic device according to claim 21, also including a high frequency HF generator, or an RC oscillator, arranged to produce the high frequency HF signal.

24. The electronic device according to claim 23, wherein the first counter and/or the second counter and/or the high frequency HF generator are respectively a first counter and/or a second counter and/or an HF generator of a microcontroller.

25. The electronic device according to claim 24, formed of a first integrated circuit in which are encapsulated the internal time base and the adjustment circuit, and a second integrated circuit including the self-calibration circuit and the microcontroller.

* * * * *